US005330115A

United States Patent [19]

Mayer et al.

[11] Patent Number: 5,330,115

[45] Date of Patent: Jul. 19, 1994

[54] METHOD AND APPARATUS FOR FORMING A RESERVE WINDING ON A ROTATING EMPTY TUBE

[75] Inventors: Walter Mayer, Ingolstadt; Sebastian Brandl, Böhmfeld; Josef Neumeyer, Ingolstadt, all of Fed. Rep. of Germany

[73] Assignee: Rieter Ingolstadt Spinnereimaschinenbau AG, Ingolstadt, Fed. Rep. of Germany

[21] Appl. No.: 947,785

[22] Filed: Sep. 18, 1992

[30] Foreign Application Priority Data

Sep. 19, 1991 [DE] Fed. Rep. of Germany ..... 4131178

[51] Int. Cl.[5] ..... B65H 54/02

[52] U.S. Cl. ..... 242/18 PW; 242/35.5 A; 57/263

[58] Field of Search ..... 242/18 PW, 35.5 A; 57/263, 266, 268, 269, 270

[56] References Cited

U.S. PATENT DOCUMENTS

| | | | |
|---|---|---|---|
| 4,327,546 | 5/1982 | Derichs et al. | 57/263 |
| 4,821,502 | 4/1989 | Bursek et al. | 57/263 |
| 4,891,933 | 1/1990 | Raasch | 57/263 X |
| 4,928,475 | 5/1990 | Matsui et al. | 242/18 PW X |
| 5,022,222 | 6/1991 | Rupert et al. | 57/263 |
| 5,083,716 | 1/1992 | Colli et al. | 242/35.5 A |
| 5,150,845 | 9/1992 | Colli et al. | 242/35.5 A |

FOREIGN PATENT DOCUMENTS

| | | |
|---|---|---|
| 0069205 | 1/1983 | European Pat. Off. . |
| 3039857 | 5/1981 | Fed. Rep. of Germany . |

*Primary Examiner*—Stanley N. Gilreath
*Attorney, Agent, or Firm*—Dority & Manning

[57] ABSTRACT

In order to form parallel windings in the longitudinal end region of the empty tube, a drive roller, which is driven at a peripheral speed adapted to the constant thread withdrawal speed provided for the subsequent formation of the crosswinding, is placed onto the peripheral surface of the empty tube, which has been lifted from the winding cylinder, and the thread, which is delivered at a constant speed, is passed to the then driven empty tube. After formation of the reserve winding, the empty tube is lowered onto the winding cylinder. The thread is displaced towards the middle of the bobbin and, by way of adaptation to the shortening of the thread run occasioned thereby and to a change in diameter possibly then brought into effect, the peripheral speed of the drive roller is altered to maintain a constant thread wind-on tension. The thread is passed to the cross-winding device, and the drive roller is lifted from the empty tube. To form the reserve winding, a thread guide is movable into the region of the empty tube, which is held at a distance from the winding cylinder by the bobbin-lifting device. The drive of the drive roller together with the thread guide is connected to a common control device.

27 Claims, 2 Drawing Sheets

METHOD AND APPARATUS FOR FORMING A RESERVE WINDING ON A ROTATING EMPTY TUBE

BACKGROUND OF THE INVENTION

The present invention relates to a method of forming a reserve winding on a rotating empty tube, to which a thread drawn off at a constant speed from a work station is passed in order to form parallel windings in the longitudinal end region of the empty tube before passing it to a cross-winding device to form a cross-winding pattern of the thread on the empty tube. The tube is driven at a constant peripheral speed by a winding cylinder. The invention also relates to an apparatus for carrying out the method.

In a known method for forming the reserve winding, the empty tube is driven at the normal winding speed (EP-OS 69 205). This gives rise to a thread excess, which leads to disturbances during the winding-up process and is, therefore, particularly in the case of larger reserve windings, compensated for by temporary storage.

It is further known to hold an empty tube, during the formation of parallel reserve windings, between three roller pairs, of which one pair is driven in a defined, fixed speed ratio relative to the winding cylinder (DE 30 39 857 A1). In this manner, it is possible during the formation of the parallel reserve windings to maintain a wind-on tension which corresponds to the wind-on tension during production. With this apparatus it is, however, impossible to avoid changes in tension when, after the parallel reserve windings have been formed, the thread is fed to the cross-winding thread guide.

SUMMARY OF THE INVENTION

The object of the present invention is to enable the thread, from the start of reserve winding formation up to the passing of the thread to the cross-winding thread guide, to be wound at the tension provided during the normal spinning process, without temporary storage of the thread being required for the process.

This object is achieved according to the invention in that a drive roller, which is driven at a peripheral speed adapted to the constant thread withdrawal speed provided for the subsequent formation of the crosswinding, is placed onto the peripheral surface of the empty tube, which has been lifted from the winding cylinder. The thread is then passed to the empty tube in order to form the reserve winding, and after the formation of the reserve winding, the empty tube is lowered onto the winding cylinder. The thread is displaced towards the middle of the bobbin and, by way of adaptation to the shortening of the path occasioned by the thread displacement and to a change in its diameter, brought into effect for winding-on of the thread. The peripheral speed of the drive roller is altered to maintain a constant thread wind-on tension. The thread is then passed to the cross-winding device and the drive roller is lifted off the empty tube. In this manner, during formation of the thread reserve winding the empty tube is driven, not in the hitherto standard manner by the winding cylinder, but by a separate drive roller which may be driven independently of the winding cylinder speed and, by virtue of its having a higher peripheral speed than the winding cylinder, takes up the thread excess. The constant wind-on speed is maintained by a corresponding speed control of the drive roller from the start of forming the reserve winding up to the passing of the thread to the cross-winding device. During this process, the peripheral speed of the drive roller is fixed in such a way that it differs by so much from the constant thread withdrawal speed that a tension draft arises which is substantially equal during the subsequent formation of the crosswinding. In the case of cylindrical tubes, the peripheral speed of the drive roller is, therefore, higher than the peripheral speed of the a pair of take-off rollers used for withdrawing the thread from the spinning device, while, in the case of conical tubes on which the reserve winding is formed at the large-diameter end the drive roller peripheral speed is correspondingly lower than the peripheral speed of the pair of take-off rollers.

According to an embodiment of the method according to the invention, the thread wind-on tension is monitored, and the peripheral speed of the drive roller is controlled in such a manner that a constant thread wind-on tension is maintained. To this end, during the formation of a reserve winding on cylindrical tubes a higher, and during formation of a reserve winding on the larger-diameter end of a conical tube, a lower peripheral speed of the drive roller has to be maintained compared to the peripheral speed of the pair of take-off rollers and has to be slightly variable to allow for adaptation to variations in the tension during winding-on.

The drive roller may perform a plurality of functions and may, for example, drive the empty tube, on which, for example, a plurality of starter windings are wound during a piecing process preceding the formation of the thread reserve winding. For this reason, it is preferably provided that the drive roller is advanced towards the empty tube to drive the tube during a piecing process preceding formation of the reserve winding and remains there, up to or till after the passing of the thread to the cross-winding device.

According to an advantageous embodiment of the method according to the invention, it is provided that, before the start of a bobbin change, the full bobbin is lifted from the winding cylinder. The drive roller is placed onto the peripheral surface of the full bobbin, braked to a standstill and then lifted from the full bobbin. The full bobbin is then exchanged for an empty tube and, for the subsequent piecing process, the drive roller is placed onto the empty tube to drive it during the take-up of the thread and the formation of the thread reserve winding. In such a case, the drive roller serves both to stop the full bobbin which is to be exchanged, to effect the piecing process (e.g. with the aid of starter windings provided on the empty tube or with the aid of a piecing thread drawn off from a special piecing bobbin) and to receive the thread for formation of the reserve winding.

When piecing is effected with the aid of a thread end unwound from the full bobbin, the drive roller may likewise be used both for piecing and for the formation of the thread reserve winding. In such a case, according to a further advantageous embodiment of the method according to the invention it is provided that, before the start of a bobbin change, the full bobbin is lifted from the winding cylinder and the drive roller is placed onto the peripheral surface of the full bobbin and braked to a standstill. It is then driven in the unwinding direction to effect a piecing process. The drive roller is then lifted from the full bobbin and the moving thread extending to the full bobbin is cut and the full bobbin is exchanged for an empty tube. The drive roller is then placed onto the empty tube to drive it in the winding direction for receiving the thread brought to a defined length and for receiving the reserve winding. The piecer thread may, after return of the thread to the work station, be drawn off again independently of the work station or be wound temporarily onto the full bobbin. In the latter case, according to the invention, the drive roller, after the drive process, preceding its application onto the empty tube, of the full bobbin in the unwinding direction, is temporarily driven in the winding direction to receive the piecer thread and then again in the unwinding direction so that the piecer thread is unwound from the full bobbin and extracted, together with the thread subsequently delivered from the work station. The drive roller, for the exchange of the full bobbin for an empty tube which precedes formation of the reserve winding, is lifted from the full bobbin. This process, preceding the formation of the reserve winding, of braking the full bobbin prior to effecting the bobbin change creates the precondition for a reduction in the period up to formation of the reserve winding.

The empty tube, after formation of the crosswinding and up to the drive by the winding cylinder, is never left to its own devices and hence uncontrolled. It is preferably provided that the empty tube is driven by the drive roller until after the tube has been placed onto the winding cylinder.

Since the peripheral speed of the drive roller, while it is driving the empty tube lifted off from the winding cylinder, is higher than the peripheral speed of the winding cylinder, it is advantageous if the peripheral speed of the drive roller is reduced, while the empty tube is being placed onto the winding cylinder, to the peripheral speed of the winding cylinder and, only then, is the drive roller lifted from the empty tube. Thus, in a simple manner, a rapid adaptation of the peripheral speed of the empty tube to the peripheral speed of the winding cylinder is achieved, with the result that, when the thread subsequently delivered from the work station is inserted into the cross-winding device, the peripheral speed of the empty tube already presents the necessary winding speed. Uncontrolled thread tension conditions are, therefore, substantially avoided.

This reduction in the peripheral speed of the drive roller is advantageously effected by braking the drive roller, with the braking preferably being effected electrically.

As described above, the drive roller is braked from its higher rotational speed down to the peripheral speed of the winding cylinder. To avoid excessive braking, which would have an adverse effect upon the bobbin surface and, hence, upon the thread wound thereon, in an advantageous embodiment of the method according to the invention, it is provided that, during the braking of the drive roller, an electric characteristic proportional to the peripheral speed of the drive roller is generated. This characteristic is monitored and on the attainment of the peripheral speed of the winding cylinder causes a discontinuation of the braking process. Advantageously, a voltage is generated as the electric characteristic.

To effect this method, the thread guide may be brought into the region of the empty tube, which is held at a distance from the winding cylinder by the bobbin-lifting device. Associated with the drive roller is a drive, by means of which the drive roller may be driven at a peripheral speed adapted to a peripheral speed of the pair of take-off rollers for withdrawing the tread and which, together with the thread guide, is connected to a common control device. The effect achieved is that, when the thread during formation of the thread reserve winding is drawn off from the work station by the pair of take-off rollers, no thread excess arises between the take off rollers and the empty tube. If thread withdrawal from the work station is effected with the aid of an element other than the pair of take-off rollers, here, too, it is ensured that, after the passing of the thread to the empty tube, the thread continues to be drawn off from the work station at the desired speed, thereby preventing any thickness changes in the thread. Furthermore, the apparatus according to the invention allows the thread to always be wound onto the empty tube at the desired tension, resulting in the trouble-free formation of the reserve winding. Joint control of the thread guide and the drive roller allows the peripheral speed of the drive roller to be fixed in such a way as to compensate for the movement of the thread guide into the range of traverse of the cross-winding device and any changes in the diameter of the empty tube, which lie in the range of movement of the thread guide.

To allow the drive of the drive roller to be synchronized with the lifting and lowering of the bobbin or the empty tube, in a further advantageous embodiment of the invention it is provided that the bobbin-lifting device and the drive roller are connected to a common control device.

To allow for the empty tube to be brought by the drive roller from its higher speed down to the peripheral speed of the winding cylinder, in a further advantageous embodiment of the apparatus according to the invention it is provided that a braking device is associated with the drive roller and the braking device may take the form of an electric braking device. It is particularly advantageous if the electric braking device takes the form of a d.c. machine with a converter.

In a simple embodiment of the apparatus according to the invention, a control device is associated with the braking device for fixing the braking period. Alternately, or additionally, a speed governor, which is connected for control purposes to the braking device, may be associated with the cross-wound bobbin. Advantageously, the speed governor may be advanced to the cross-wound bobbin and is disposed on a maintenance device, which is displaceable along a plurality of identical empty tubes, which are driven by winding cylinders. Thus, there is no need for a separate speed governor for each cross-wound bobbin.

The speed governor may, in principle, take a different form, e.g. that of a centrifugal governor, etc. Preferably, however, the speed governor takes the form of a measuring instrument of an electric characteristic generated by the d.c. machine, with the measuring instrument, in a particularly advantageous manner, taking the form of a voltage indicator.

If a plurality of identical empty tubes driven by winding cylinders are provided adjacent to one another on the machine, it is advantageous to dispose the drive roller on a maintenance device which is displaceable along the empty tubes.

To allow the drive roller to be used not only for the phase of forming a thread reserve winding but also during piecing, in a preferred embodiment of the apparatus according to the invention, it is provided that the drive roller is connected, for control purposes, to a piecing device and/or bobbin-changing device.

According to the preferred embodiment of the apparatus according to the invention, it is provided that the drive roller is, simultaneously, part of both the bobbin-changing device, the piecing device, the braking device, and a fault signal transmitter.

The apparatus, according to the invention, is of a simple construction and may also be easily retro-fitted at a work station having a driven cross-wound bobbin, because, given the standard elements provided at a work station, the method according to the invention need only be modified slightly. A thread reserve winding of perfect quality is formed in a simple manner. Moreover, the start of the bobbin build-up is also of a perfect quality. The apparatus according to the invention is very time-saving in operation it may be used in conjunction with a preceding bobbin change and, as a result of positive braking of the full bobbin, substantially contributes to a shortening of the bobbin-changing time and hence the time leading up to the formation of the thread reserve winding.

BRIEF DESCRIPTION OF THE DRAWINGS

An embodiment of the invention is described in greater detail hereinafter with reference to drawings. The drawings show.

DETAILED DESCRIPTION OF THE INVENTION

Figure 1:
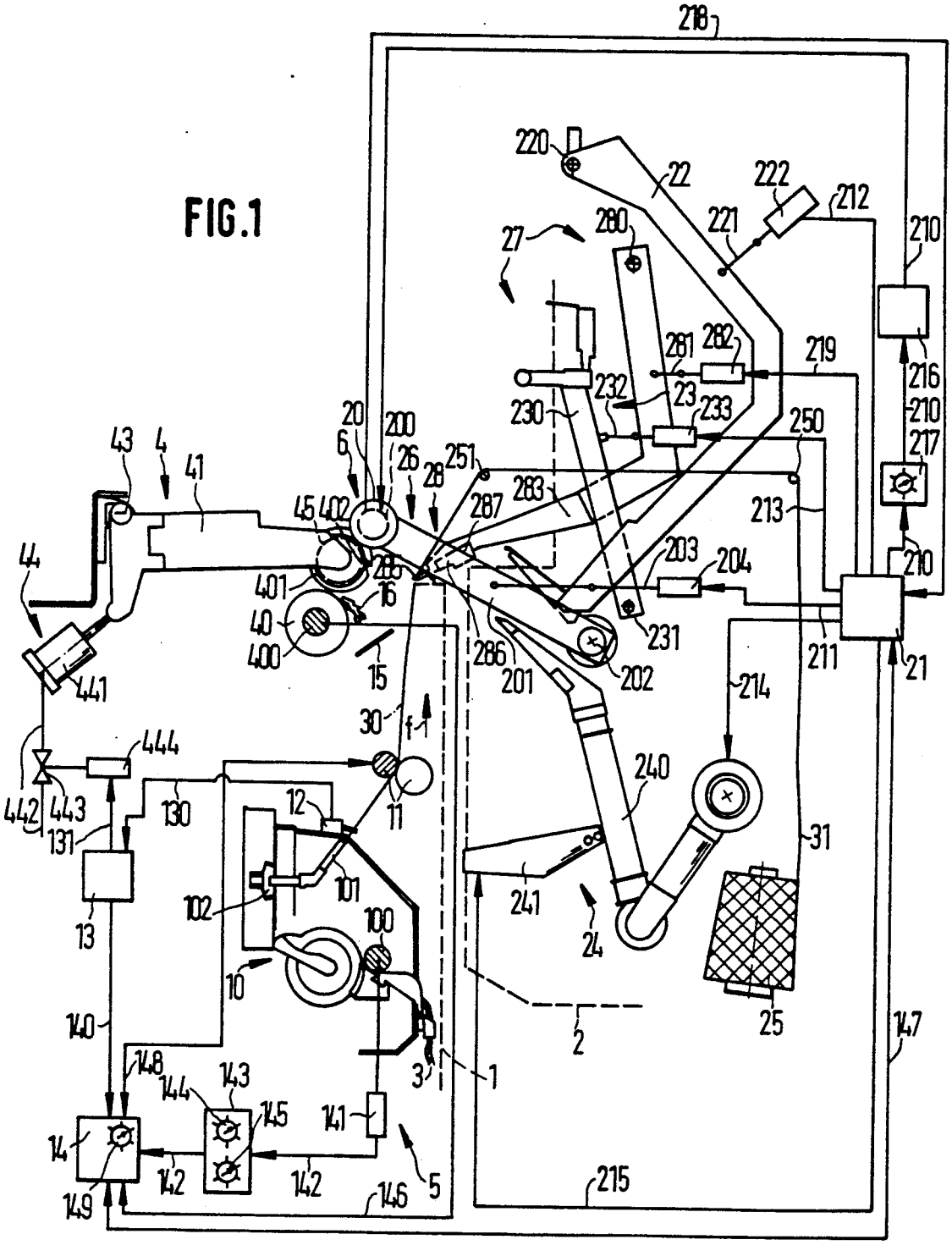
FIG. 1 is a diagrammatic cross-sectional view of an open-end spinning device and a maintenance device constructed according to the invention.

The drawings show, diagrammatically, only those parts which are essential to an understanding of the invention. These parts are, as rule, distributed on a spinning machine 1 and a maintenance device 2, which is displaceable along the spinning machine 1, although it is alternatively possible to provide all the illustrated elements on the spinning machine 1 itself and dispense with the maintenance device 2, especially in test machines with a single spinning station or with only a few spinning stations.

The illustrated spinning machine 1 has a plurality of adjacent spinning stations of which, however, only a single spinning station is shown in the drawing. One conventionally designed open-end spinning device 10 per spinning station is provided, to which a staple sliver 3 is fed by means of a feed roller 100. The open-end spinning device 10 has a spinning element 102, e.g. in the form of a spinning rotor, on whose fibre-collecting surface the fibres collect before being spun into the end of a thread 30. The thread leaves the open-end spinning device 10 through a thread removal tube 101 by being drawn off through the thread removal tube 101 by a pair of take-off rollers 11 which is driven at a constant speed. Disposed in the thread run between the thread removal tube 101 and the pair of take-off rollers 11 or, in thread running direction (arrow f), downstream of the pair of take-off rollers 11 is a thread monitor 12.

A winding device 4 is provided for winding the thread 30 removed from the open-end spinning device 10, which comprises a winding cylinder 40, driven by means of a drive 400, for driving a bobbin (not shown) which is exchangeable accommodated between two pivotable mounted bobbin arms 41. The bobbin arms 41 may be pivoted about an axis 43. On their ends, the bobbin arms carry bobbin disks 401, one of which has a thread-catching notch 402.

Acting upon the winding device 4 is a bobbin-lifting device 44, whose task is to lift the bobbin (not shown) from the winding cylinder 40 and hold it or a newly inserted empty tube at a distance from the winding cylinder 40. The bobbin-lifting device 44 has, as a drive, a cylinder 441 to which a suitable control medium may be supplied through a line 442. A control valve 443, with which a drive 444 is associated, is disposed in the line 442 for controlling the control medium. A means is also provided in a suitable manner (not shown) for emptying the cylinder 441 in that, for example, the control valve 443 may, with the aid of its drive 444, be suitably connected to a discharge line.

The thread monitor 12 and the drive 444 of the control valve 443 are connected for control purposes to a spinning station control device 13 (see operational connections 130 and 131), to which a sensor (not shown) for detecting the rotational speed of the driven roller of the pair of take-off rollers 11 is connected via an operational connection 148. The spinning station control device 13 is in turn connected by an operational connection 140 to a central control device 14 of the spinning machine 1. The control device 14 has a setting device 149 for setting the tension draft, i.e. for controlling the winding speed of the winding device 4 by controlling the peripheral speed of the winding cylinder 40 in relation to the peripheral speed of the driven roller of the pair of take-off rollers 11.

Disposed in the thread run between the pair of take-off rollers 11 and the winding device 4 are a conventional thread tension compensating device 15 and a conventional cross-winding device 16, e.g. a cross-winding roller or a cross-winding thread guide, for laying the thread 30 to be wound in a cross-winding manner on the bobbin in the form of a cross-wound bobbin.

Associated with the feed roller 100 is a sensor 141, which detects the rotational speed of the feed roller 100. Sensor 141 is connected by means of an operational connection 142 to the control device 14, with the insertion of an adjusting device 143 which, in the illustrated embodiment, comprises two setting elements 144 and 145. The setting element 144 is used to set a thread length at which a bobbin change should occur, while the setting element 145 is used to set a tolerance thread length, by which the bobbin change may vary compared to the set (desired) thread length. The sensor 141 together with the adjusting device 143 forms a thread length measuring device 5 which, for control purposes, is connected by the control devices 14 and 13 to the bobbin-lifting device 44.

The control device 14 is connected by an operational connection 146 to the drive 400 of the winding cylinder 40.

All the device required to effect a bobbin change and the subsequent piecing process are disposed on the maintenance device 2 although, for reasons of clarity, only those units which are absolutely essential to an understanding of the invention are illustrated in the drawing.

One of the devices essential to an understanding of the invention is a drive roller 20, which may be selectively driven in one or the other direction by means of a drive 200. Associated with the drive roller 20 is a braking device 26, which may be formed by the drive 200, e.g. in the form of a d.c. machine or motor which may be switched over from the drive mode to the braking mode.

The drive roller 20 with its drive 200 is disposed on the end of a pivot arm 201, which may be pivoted about a pivot axis 202. To this end, there is hinged on the pivot arm 201 a coupling member 203, which may be pivoted back and forth with the aid of a drive element 204, e.g. a pneumatic or hydraulic piston. In this manner, the drive roller 20 may be brought to rest upon the bobbin (not shown) or upon an empty tube 45 or may also be lifted off again.

Both the drive 200 and the drive element 204 are, for control purposes, connected (see operational connections 210, 218 and 211) to a control device 21 disposed on the maintenance device 2. Disposed in the operational connection 210 of the drive 200 in the form of a d.c. machine or motor, are a converter 216 and a timing device 217.

A bobbin-changing device 27, which comprises a bobbin ejector 22 and a tube supply device 23, is also disposed on the maintenance device 2.

The bobbin ejector 22 may be pivoted about a pivot axis 220 and is connected by means of a coupling member 221 to a drive element 222, for example in the form of a cylinder, which is, in turn, connected by an operational connection 212 to the control device 21.

The tube supply device 23, already mentioned, is also provided for inserting an empty tube 45 into the winding device 4 and comprises at least one pivot arm 230, which may be pivoted about an axis 231. To this end there is, hinged on the at least one pivot arm 230, a coupling member 232 connected to a drive element 233, which is, in turn, connected for control purposes by an operational connection 213 to the control device 21.

A thread guide 28, disposed on an arm 283 which is pivoted about an axis 280, is provided for passing the pieced thread 31 onto the empty tube 45. To this end, the thread guide 28 is connected by a coupling member 281 to a suitable drive 282 which (in the same manner as the drive 200 of the drive roller 20) is, in turn, connected for control purposes by an operational connection 219 to the control device 21.

Figure 2:
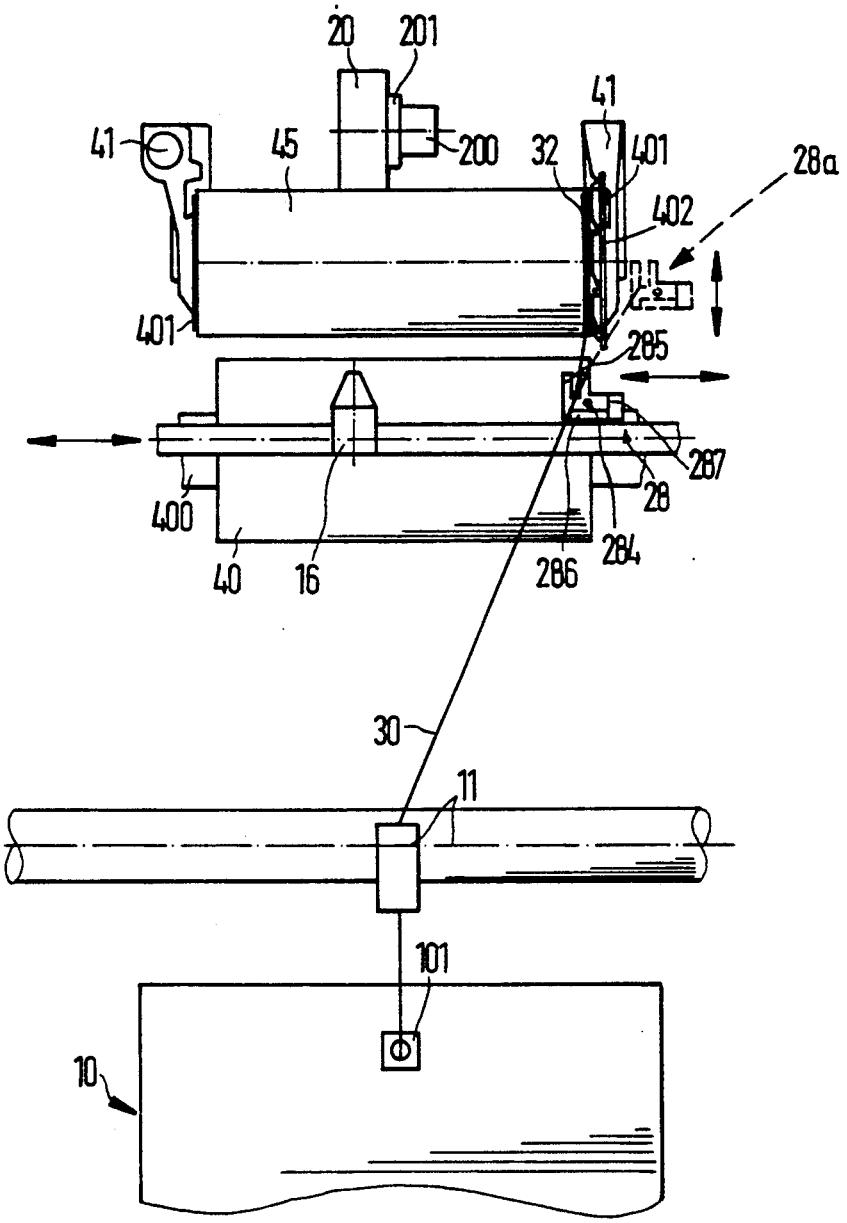
FIG. 2 is a front view of a work station and its associated winding device.

The thread guide 28 is (as a result of axial displacement of the arm 283 on the axis 280 or the pivoting of the thread guide 28 relative to the arm 283 parallel to the axis of the empty tube 45 received by the bobbin arms 41) movable into a position, in which it is situated in the region of the empty tube 45 which has been lifted by the bobbin-lifting device 44 from the winding cylinder 40, with the result that the pieced thread 31 crosses the path of the thread-catching notch 402 provided on one of the two bobbin disks 401 (see FIG. 2).

The thread guide 28 further carries a guide element 285, which may be pivoted about an axis 284 and is connected by means of a coupling member 286 to a drive 287, e.g. an electromagnet.

Further disposed on the maintenance device 2 is a piecing device 24, of which only the most important parts are shown, namely, a thread-seeking nozzle 240 and a pivotable thread regulator 241, which are connected by operational connections 214 and 215 to the control device 21.

An auxiliary bobbin 25 is also disposed on the maintenance device 2. An auxiliary thread 31 is led from said bobbin via guide devices 250 and 251 as far as into the vicinity of the mouth of the thread-seeking nozzle 240. The necessary transport and cutting means are not shown in the drawing since said means is of a conventional construction.

The control devices 14 and 21 are, for control purposes, connected to one another by an operational connection 147.

Since both the drive 200 as well as the bobbin ejector 22 and tube feed device 23 are connected, via operational connection 210 and operational connections 212 and 213 respectively, to the common control device 21, the braking device 26 (drive 200) is also connected for control purposes to the bobbin-changing device 27.

Since the control devices 14 and 21 are connected for control purposes to one another, the thread length measuring device 5 is also connected for control purposes to the bobbin-changing device 27. Similarly, via the control devices 14 and 21, the bobbin-lifting device 44 and the bobbin-changing device 27 and/or the piecing device 24 and the drive 200 of the drive roller 20 as well as the thread guide 29 are also connected to one another.

Having described the layout of the preferred construction of an open-end spinning device 10 and the displaceable maintenance device 2 which cooperates therewith, there now follows a description of the mode of operation:

During normal production, the sliver 3 is fed by the feed roller 100 to the open-end spinning device 10, opened in the open-end spinning device 10 in the usual manner to form individual fibres, and temporarily deposited in the spinning element 102 before being incorporated into the end of a thread which is being drawn off. This thread is drawn out of the open-end spinning device 10 through the thread removal tube 101 by the pair of take-off rollers 11 and is deposited, with the aid of the cross-winding device 16, in a cross-wound manner on the bobbin which, during production, is supported on and driven by the rotating winding cylinder 40.

Prior to the start of the operation of the open-end spinning device 10, the desired thread length to be wound onto the bobbin is set in the adjusting device 143 with the aid of the setting element 144. The tolerance thread length, by which the thread length may differ from the preset desired thread length, is also set with the aid of the setting element 145 in order to avoid prolonged stoppage periods for the open-end spinning device 10 in questions, in the manner described in greater detail below.

Once the preset thread length has been reached at the open-end spinning device 10, the open-end spinning device 10 is stopped by interrupting the supply sliver 3 to the open-end spinning device 10. This gives rise to a thread breakage, with the result that the thread monitor 12 responds and, via the spinning station control device 13 and the bobbin-lifting device 44, causes the bobbin to be lifted from the winding cylinder 40. The bobbin is, therefore, separated from its drive and slows down but, owing to the inertia of the bobbin 42, it is some time, possibly as long as several minutes, before the bobbin finally comes to a halt.

The spinning station, at which a bobbin change is to be effected, is normally at a standstill when the maintenance device 2, in the course of its normal maintenance run, happens to travel past the spinning station in question or it travels, on the basis of a request triggered by discontinuation of the sliver supply to the open-end spinning device 10, to the spinning station and stops there to carry out the necessary bobbin change.

The waiting period up to arrival of the maintenance carriage 2 at the spinning station where a bobbin change is to be effected may turn out to be relatively long and so occasion correspondingly high production losses. For this reason, a tolerance thread length, by which the thread length may differ from the desired thread length, is entered by means of the setting element 145 into the adjusting device 143. If the maintenance device 2, as it travels along the open-end spinning machine 1, comes to an open-end spinning device 10 where the desired thread length on the bobbin has been reached but the permitted tolerance thread length has not yet been exceeded, the maintenance device 2 will be stopped at the open-end spinning device 10 in questions, this being effected by means which are conventional and therefore are not shown.

Upon attainment of the desired thread length (taking into account a possibly preset tolerance thread length), the maintenance device 2 effects a thread breakage which, via the thread monitor 12 and the bobbin-lifting device 44, triggers the lifting of the bobbin by a defined lifting height from the winding cylinder 40. Because of its inertia, however, the bobbin continues to rotate and gradually loses speed before finally coming to a halt.

If a bobbin change is effected before a bobbin comes to a halt, the action of the bobbin ejector 22 upon the rotating bobbin surface could cause a fault in the top windings of the crosswinding which, when the bobbin was later deposited on a bobbin conveyor belt and carried to a bobbin collection point, could lead to further faults and so is to be avoided. On the other hand, if it was necessary to wait until the full bobbin came to a standstill, a great deal of time would be lost. For this reason, the drive 200 of the drive roller 20, designed as braking device 26, is moved into its braking position, which is effected by switching over the converter 216. The bobbin is, therefore, braked to a standstill.

By virtue of the preset tolerance thread lengths, the maintenance device 2 is frequently able to carry out a bobbin change during its normal patrol run, so that waiting periods are substantially avoided.

Also, when the maintenance device 2 happens to reach an open-end spinning device 10 just as it stops because the desired thread length has been reached or a thread breakage has occurred, a signal to this effect, produced by the maintenance device 2, causes the bobbin to be lifted from the winding cylinder 40 and braked to a standstill with the aid of the braking device 26.

The displaceable maintenance device 2, which is used to effect such lifting of the bobbin from the winding cylinder 40, may be a combined bobbin-changing and piecing device or an independent bobbin-changing device. In the latter case, in addition to the maintenance device accommodating the bobbin-changing device 27, a separate maintenance device accommodating a piecing device 24 is provided.

The bobbin change is then effected, in that the drive roller 20, which was applied to brake the bobbin after it was lifted from drive cylinder 40, is lifted from the bobbin and the control device 21, via the operational connection 212 and the drive element 222, actuates the bobbin ejector 22 which ejects the full bobbin from the winding device 4 and deposits it on a conveyor belt (not shown), which carries the bobbin to the above-mentioned bobbin collection point. Ejection of the full bobbin does not damage its crosswinding because at that moment the bobbin is no longer rotating.

Following the ejection of the full bobbin, the control device 21, via the operational connection 213, effects the pivoting of the tube supply device 23, which then (in a conventional manner) inserts an empty tube 45 between the raised bobbin arms 41 of the winding device 4. The winding device 4 is then ready for a new piecing process and the drive roller 20 may be placed onto the peripheral surface of the newly inserted empty tube 45.

The piecing process actually begins during the bobbin change but, at the latest, on completion of the bobbin change. During this process, the spinning element 102 is stripped or cleaned in a known manner. Furthermore, the auxiliary thread 31, extending as far as into the vicinity of the thread-seeking nozzle 240, is picked up by the thread-seeking nozzle 240 while, in a known manner, being drawn off from the auxiliary bobbin 25 and fed to the thread-seeking nozzle 240. Once a sufficiently long piece of thread 240 has been sucked in and received by the thread-seeking nozzle 240, the thread-seeking nozzle 240 is moved into such a position that the auxiliary thread 31 may leave the thread-seeking nozzle 240 through a longitudinal slot facing the spinning machine 1 and passes into the pivoting range of the thread regulator 241. The latter is then pivoted and receives the auxiliary thread 31, which is then brought by means (not shown) to a defined length and into a defined shape. The thread end is then moved in front of the mouth of the thread removal tube 101 and returned into a stand-by position inside the tube. In the process, a thread reserve is formed, in a manner which is not shown, in the run of the auxiliary thread 31.

The fibre supply into the open-end spinning device 10 is then resumed. In synchronism therewith, the thread reserve is released so that the thread end passes onto the thread collecting surface of the spinning element 102 and combines with the fibres situated there.

The pieced thread is then drawn off and carried away from the open-end spinning device 10 by means (not shown), which may be associated, for example, with the guide device.

The drive roller 20 is then driven in the thread winding direction and, via the empty tube 45, also drives the bobbin disk 401 with the thread-catching notch 402.

During the thread return or alternatively only during the withdrawal of the newly pieced thread, the thread extending to a thread delivery (not shown) is inserted into the thread guide 28, which lies in the longitudinal end region of the empty tube 45 and now moves into position 28*a* (FIG. 2). The thread extending from the thread removal tube 101 to the thread delivery (not shown) therefore crosses the path of the thread-catching notch 402 provided on the bobbin disk 401. The thread is intercepted by the thread-catching notch 402 and drawn into the gap between thread-catching notch 402 and empty tube 45. The thread extending to the thread delivery (not shown) is then cut, with the separated piece of thread being carried away.

The thread guide 28 then moves back into its position illustrated by a solid line in FIG. 2 and holds the thread, which is substantially delivered by the open-end spinning device 10 and wound onto the empty tube 45, in the region of a surface line outside of the subsequent crosswinding. The parallel windings, thus formed, form a reserve winding 32 which is needed later for connection to the thread of another bobbin.

Since the pieced thread 30, in the course of its removal as just described, prior to being passed to the empty tube 45 is drawn off either by the pair of take-off rollers 11 or by a withdrawal device (not shown) associated with the guide device 250 (depending on which known piecing method is selected) at a defined withdrawal speed, namely the production withdrawal speed, there arises, in the case of the conventional peripheral speed being determined by the peripheral speed of the winding cylinder 40, a speed differential between the withdrawal speed and the thread winding speed. The reason for this is that the peripheral speed of the winding cylinder 40 is tuned to the peripheral speed of the pair of take-off rollers 11 or another withdrawal device in a manner which takes into account the side-to-side traverse motion occurring during the formation of the crosswinding. During formation of the reserve winding 32, however, there is no side traverse motion so that (in the case of cylindrical tubes 45) the thread length wound on during one revolution of the empty tube 45 is shorter than during the subsequent formation of the crosswinding.

The thread excess thus produced forms a thread surplus which either leads to loose thread reserve windings, which may easily fall off the end of the empty tube 45, or has to be provisionally accommodated by a temporary storing device until the temporarily stored thread supply may be used up again later during formation of the crosswinding.

To avoid these drawbacks, the drive roller 20 is driven, for the purpose of forming the reserve winding 32, at a speed which is adapted to the constant thread withdrawal speed provided for subsequent formation of the crosswinding. The speed of the drive roller 20 is, as a rule, not the same as the constant thread withdrawal speed corresponding to the production withdrawal speed but is higher by such an amount that the desired tension draft is achieved even during the formation of the thread reserve 32.

On completion of the reserve winding, the drive 287 pivots the guide element 285 so that the thread 30, extending from the pair of take-off rollers 11 or the open-end spinning device 10 to the empty tube 45, is released and moves, owing to the tension draft, towards the middle of the tube.

During this thread displacement from the region of the formed reserve winding 32 into the cross-winding range of the cross-winding device 16, the path of the thread 30 shortens between the pair of take-off rollers 11 and the point of the empty tube 45 on which the thread 30 is wound. Thus, without further measures, the winding tension decreases so that loose windings are formed on the empty tube 45. To compensate the decreasing winding tension in the case of cylindrical empty tubes 45 or slightly conical empty tubes 45, where the reserve winding 32 is generally formed on the tube end with the larger diameter, the speed of the drive roller 20 is increased in such a way that the resultant wind-on tension remains substantially unaltered.

In this adaptation of the peripheral speed of the drive roller 20 and the empty tube 45, however, it is not only the shortening of the thread run between the pair of take-off rollers 11 and the run-on point of the thread 30 onto the empty tube 45 which is taken into account. In the case of conical empty tubes 45, particularly those with a greater amount of taper, the reserve winding 32 is (as mentioned above) usually formed on the end of the empty tube with the greater diameter. When the thread 30, after its release, is moved by the thread guide 28 (or also by a movement of the thread guide towards the middle of the bobbin or empty tube) into the traverse range of the cross-winding device 16, the diameter of the empty tube 45 reduces in the thread run-on region. This means that, if the peripheral speed of the empty tube 45 remains constant, the winding tension decreases both because of the shortened thread run and because of the reduced effective diameter of the empty tube 45. Compensating for this reduced effective peripheral speed of the empty tube 45, i.e. the peripheral speed of the empty tube 45 in the region of the tube onto which the thread 30 runs during winding, is even more important in such a case than with cylindrical empty tubes 45 or those with only a slight amount of taper. As already stated, this compensation is effected by adapting the drive speed of the drive roller 20 to the changing thread run.

To ensure the time coordination with the release of the thread 30 or the pivot movement of the thread guide 28 towards the middle of the bobbin or empty core, which is necessary for the control of the drive speed of the drive roller 20, the thread displacement and the change in the thread winding speed are synchronized in that the drive 200 of the drive roller 20 and the thread guide 28 are connected for control purposes to a common control device 21.

In synchronism with the thread displacement, the empty tube 45 is lowered onto and, then driven by, the winding cylinder 40. The thread passes into the cross-winding range of the cross-winding device 16, thereby allowing the latter to deposit the thread in a cross-wound manner to form a crosswinding. The drive roller 20, which in the meantime has assumed the peripheral speed of the winding cylinder 40, is then no longer required to drive the empty tube 45 and is lifted from the tube.

Piecing is completed and winding of the thread on the bobbin in formation is effected in the usual manner.

During formation of the reserve winding 32, the empty tube 45 has a higher peripheral speed than the winding cylinder 40. To prevent the empty tube 45, upon completion of the formation of the reserve winding and after its lowering onto the winding cylinders 40, from being exposed to the action of two drives running at different speeds (winding cylinder 40 and drive roller 20), the drive roller 20 moves away from the empty tube 45 as soon as the tube is lowered onto the winding cylinder 40.

On the other hand, to prevent the empty tube 45 from being left uncontrolled for even a moment in terms of its drive, the drive roller 20 remains in contact with, and drives, the empty tube 45 until the empty tube 45 has been placed onto the winding cylinder 40, and, hence, until the thread has been passed to the cross-winding device 16, but its speed is reduced during the lowering of the empty tube 45, down to the peripheral speed of the winding cylinder 40. In principle, this may be effected by disconnecting the drive of the drive roller 20 and delaying lowering of the empty tube 45. A simpler way of achieving this, which involves less complicated monitoring, is to brake the drive roller. In this manner, the empty tube 45 is temporarily driven by two drive elements rotating at the same peripheral speed, namely the winding cylinder 40 and the drive roller 20, until the drive roller 20 is lifted from the empty tube 45.

After the driving of the empty tube 45 has been taken over by the winding cylinder 40, the drive roller 20 is lifted from the empty tube 45.

The procedure is also similar in the case of a piecing operation not preceded by a bobbin change. If a thread breakage occurs, the thread monitor 12, via the spinning station control device 13 and the bobbin-lifting device 44, causes the bobbin to be lifted from the winding cylinder 40. The bobbin, therefore, slows down, this taking some time owing to its inertia. If, during this slow-down period of the bobbin, the maintenance device 2 reaches the open-end spinning device 10 in question, the drive roller 20 is applied onto the bobbin and braked. The bobbin is, therefore, brought very rapidly to a standstill.

Piecing is then effected in a manner similar to that previously described in connection with a bobbin change. The only difference is that, as a result of counter-rotating the bobbin, it is the thread end from the surface of the bobbin which is picked up by the thread-seeking nozzle 240 and returned to the open-end spinning device 10 for piecing and not the thread end of an auxiliary thread 31 drawn off from an auxiliary bobbin 25 which is used for piecing. Thread withdrawal then sets in as a result of driving the bobbin in the winding direction.

The passing of the thread to the empty tube 45 is always preceded by a piecing operation. This piecing may (in the manner described) be effected with the aid of an auxiliary thread 31, which is drawn off from an auxiliary bobbin 25, or with the aid of a thread drawn off from the winding device 4. Piecing may be effected with the aid of starter windings, which are wound on the empty tube 45. Thus, as early as during piecing, the empty tube 45 is to be driven at least in unwinding direction.

Piecing is effected in the usual manner by returning thread from the starter windings to the open-end spinning device 10, to which end the empty tube 45 with the starter windings is driven by the drive roller 20 in return or unwinding direction.

The pieced thread is then drawn off again from the open-end spinning device 10. This may be effected with the aid of the empty tube 45, which is now being driven once more by the drive roller 20 in the winding direction. Once a long enough piece of thread has been wound onto the empty tube 45 to be sure that the piecer has also passed onto the empty tube 45, the empty tube is once more driven in the unwinding, i.e. return, direction. All of the thread situated on the empty tube 45 is unwound and fed to a standard delivery device (not shown). The moving thread, which is replenished by the newly spun thread and is fed to the delivery device at the withdrawal or winding speed effective during normal production, is then passed in the manner previously described for forming the reserve winding 32 to the empty tube 45, which is once more being driven by the drive roller 20 in the winding direction, with the thread being severed from the delivered piece of thread.

Alternatively, the newly pieced thread may, with the aid of an auxiliary withdrawal device (not shown), be fed directly, without previously passing onto the empty tube 45, to the above-mentioned delivery device which carries away said newly produced thread together with the piecing thread then released by counter-rotation of the empty tube 45 by means of the drive roller 20. Once the entire length of thread previously situated on the empty tube 45 has been carried away, the subsequently delivered thread is, simultaneously severed from the piece of thread carried away and transferred to the empty tube 45, which is now being driven once more in the winding direction.

While, in principle, it is feasible to use different rollers for piecing and for forming the reserve winding 32, the different drive phases of the empty tube 45 may also be implemented by one and the same drive roller 20, which is then placed early onto the empty tube 45 so that the drive roller 20 is already driving the empty tube 45 during the piecing process. The drive roller 20 then also drives the empty tube 45 for the formation of the reserve winding and remains on said tube until, in the context of transfer of the drive of the empty tube 45 to the winding cylinder 40, the drive roller 20 is once more lifted from the empty tube 45. The drive roller 20, therefore, remains on the peripheral surface of the empty tube 45 up to transfer of the thread to the cross-winding device 16, with it being possible (as described above) for the drive roller 20 to be lifted from the empty tube 45 before, during or only after the application of the empty tube 45 onto the winding cylinder 40.

If, in conjunction with a bobbin change, a piecing operation is to be effected with the aid of a thread coming from the winding device, the full bobbin is first lifted from the winding cylinder 40. Then the drive roller 20 is placed onto the peripheral surface of the full bobbin and the bobbin is braked to a halt.

Piecing is then effected in the manner described in connection with the starter windings, in that, after the piecing return, the thread is either first wound onto the full bobbin and then unwound again from it, to be carried away by the above-mentioned delivery device, or the pieced thread is fed directly to the delivery device. During this process, the bobbin is driven by the drive roller 20.

After delivery of the piecer, the thread extending to the full bobbin into the delivery device is cut and carried away. The bobbin is then exchanged in the manner previously described for an empty tube 45, to which end the drive roller 20 has to be lifted from the bobbin.

The thread is then passed in the described manner, by means of the thread guide 28, to the empty tube 45 for formation of the reserve winding 32 and, to this end, the thread is brought by cutting to a defined length and the empty tube 45 is driven in the winding direction by the drive roller 20, which has, in the meantime, been placed onto the empty tube.

The sequence of the work operations: "placing of the empty tube 45 onto the winding cylinder 40 after formation of the reserve winding 32" "lifting of the drive roller 20 from the empty tube 45", and "transfer of the thread to the cross-winding device" may be modified. Thus, not only is it possible to lower the empty tube 45 onto the winding cylinder 40 and only then lift the drive roller 20 from the empty tube 45 (with the thread, during the lowering of the empty tube 45 onto the winding cylinder 40 or directly after placing of the empty tube 45 onto the winding cylinder 40, being released by the thread guide 28 to allow it to be received by the cross-winding device 16) but it is also quite feasible first to lift the drive roller 20 from the empty tube 45 and, only then, lower the empty tube 45 onto the winding cylinder 40 or to lift the drive roller 20 from the empty tube 45 while the empty tube 45 is being lowered onto the winding cylinder 40. Release of the thread to allow it to be transferred to the cross-winding device is always effected during or after lowering of the empty tube 45.

In principle, the bobbin change is carried out precisely when the thread wound onto the bobbin reaches a preset length. In such a case, it must, however, be accepted that the spinning station in question will occasionally be stopped for a relatively long time because, depending on the position occupied by the maintenance device 2 at the moment of its reaching the desired thread length, it may be a while before the maintenance device 2, in the course of its patrol run or on the basis of a fault signal, reaches the spinning station again.

It is much more productive to employ the method described above, whereby a specific tolerance thread length, by which the thread length may differ from the preset thread length, is accepted. In such a case, the spinning station in question is not stopped immediately upon reaching the preset thread length but only when the thread length is exceeded by the fixed tolerance thread length. Stoppage is then effected in the described manner by generating a thread breakage, which, in turn, leads to the lifting of the bobbin from the winding cylinder 40.

However, if the maintenance device 2 reaches the spinning station in question when the thread wound onto the bobbin 42 has reached or even exceeded the preset length (but before the additional tolerance thread length has been reached, which in any case triggers a stoppage of said spinning station) the maintenance device 2 produces a signal which, in a manner which is known, (and therefore not described in detail) generates a thread breakage at this spinning station and so effects the lifting of the bobbin from the winding cylinder 40.

Depending on how it is determined, such a lifting of the bobbin from the winding cylinder 40 may be triggered, not at the earliest on reaching the desired thread length, but already on reaching a thread length which falls short of the desired thread length by a preset tolerance thread length.

The tolerance thread length, by which the thread length may exceed and possibly also fall short of the desired thread length, may be, for example, fixed in advance by the adjusting device 143. Alternatively, in the manner previously described, a setting element 145 may be provided, by means of which the tolerance thread length may be preset in meters or percent. The tolerance thread length selected should not be too great. A value in the region of 0.5% of the desired thread length to be wound onto the bobbin has proved practicable as an acceptable oversize.

If need be, instead of a single setting element 145, two setting elements may be provided for setting tolerance thread lengths, with one of said setting elements fixing the tolerance thread length, by which the thread length may fall short of the desired thread length, while the other of said setting elements fixes the tolerance thread length, by which the desired thread length may be exceeded. The two tolerance thread lengths may be equal or differ and one or both of the tolerance thread lengths may assume the value zero. If both setting elements for the tolerance thread lengths are set at zero, a bobbin change is effected precisely on reaching the preset desired thread length.

Particularly gentle treatment of the full bobbin is achieved if the drive roller 20, prior to being placed upon the full bobbin, is brought, as a result of control by means of the control device 21 of the maintenance device 2 via the operational connection 210, to the peripheral speed of the winding cylinder 40. The necessary data for this are transferred from the control device 14 by the control device 21 and from there to the drive 200 of the drive roller 20. Only after the drive roller 20 has been brought to the same peripheral speed as the winding cylinder 40 and, hence, the bobbin, does the control device 21, via the operational connection 211 and the drive element 232, effect placing of the roller 20 onto the peripheral surface of the bobbin and the braking of the bobbin to a standstill.

For stopping the bobbin it is, in principle, possible to use a separate drive roller 20 which is independent of the piecing device 24. In the described construction, there is, however, no separate braking roller. Rather, this embodiment, the drive roller 20 which drives the empty tube 45 during piecing is simultaneously the roller with which the empty tube 45 is driven for forming the reserve winding 32 and, if need be, braked. The drive roller 20 is, consequently also in the context of a bobbin change, already moved to carry out the piecing process irrespective of whether piecing is effected before or after a bobbin change. Also, the drive roller 20 is not only part of the piecing device 24 and the bobbin-changing device 27, but also part of a braking device 26 and a fault signal transmitter, as is described below.

The drive 200 may likewise be of any design. If a d.c. motor is used, said motor may be switched with the aid of a converter 216 from the drive mode to the braking mode.

If faults at the bobbin-lifting device 44, particularly the valve 441, were to lead to the bobbin not lifting from the winding cylinder 40, this would have an adverse effect upon the crosswinding if both the winding cylinder 40 and the drive roller 20 acted simultaneously upon the bobbin surface for an extended period. To avoid this, it is provided that the bobbin is monitored during the braking process.

If a d.c. motor is used as drive 200, then e.g. as a result of the drive roller 20 resting on the bobbin, an electric characteristic, for example a voltage, is generated in the d.c. motor at least during the braking process and is passed via the operational connection 218 to the control device 21. If the drive roller 20 is to be brought to a reduced rotational speed, attainment of a characteristic corresponding to this speed effects a termination or discontinuation of the braking process, as well as, if desired, retention of the current speed.

If, on the other hand, no decay of the electric characteristic, e.g. voltage, sets in, then after a predetermined time the drive roller 20 will be stopped and lifted from the bobbin. Furthermore, depending on the work phase, the control device 21 ensures that the braking process is not repeated but a fault signal is generated so that an operator may check the fault source. The drive roller 20 is therefore (as mentioned above) part of a fault signal transmitter.

The predetermined time up to stoppage of the drive roller 20 may, for example, be programmed in the control device 21. According to the illustrated embodiment, this time is predetermined with the aid of the timing device 217 associated with the braking device 26.

In the illustrated embodiment, the drive 200, therefore, forms a speed governor 6. In principle, monitoring of the speed of the drive roller 20 (or also of another roller resting on the bobbin and having a braking device 26) or of the bobbin may be effected in any manner with the aid of different speed governors 6, e.g. by counting pulses generated by such a roller (e.g. drive roller 20) or the bobbin during rotation. If an electric characteristic is generated, this characteristic may, depending on the design of the speed governor 6, directly or indirectly, sampling the speed of the bobbin, also be a current intensity. Alternatively, possibly in a d.c. motor which is used as a speed governor 6, the electric characteristic may be a variation in the position of the magnetic field, In the illustrated embodiment, the speed governor 6 used is a measuring instrument for measuring the electric characteristic, which is generated by the d.c. motor (drive 200) and is dependent upon the rotational speed of the bobbin. If the induced voltage is measured, the measuring instrument used is a voltage indicator which, in the illustrated embodiment, is an integral part of the control device 21 and is, therefore, not separately illustrated.

This fault signal, which may, if desired, be generated if the bobbin cannot be stopped, offers the advantage of avoiding further attempts from the start and so cutting down the time involved. It also reduces the risk of damage to units of the maintenance device 2 and the open-end spinning device 10. The fault signal, for example, effects actuation of a fault signal transmitter, e.g. the lighting of a pilot lamp or actuation of an audible signal transmitter, so that the operator of the spinning machine 1 may look for the fault source and eliminate the fault.

The speed governor 6 (pulse counter, measuring instrument etc.) is connected for control purposes via the operational connections 210 and 212, 213 and the control device 21 to the bobbin-changing device 27. Thus, the speed governor 6 (via the control device 21) may effect not only the generation of a fault signal but also the generation of a start signal for carrying out the bobbin change. Thus, arrival of the bobbin at a standstill before or at the latest on reaching the period predetermined for the braking process may trigger the bobbin change. Such a triggering of the bobbin-changing process may (if desired) also be used when a braking period is not predetermined. In such a case, the braking action is suspended as soon as the arrival of the bobbin at a standstill is signalled, which is why the speed governor 6 is connected for control purposes to the braking device 26 via the control device 21 and possibly additionally via the control device 14 if, as is also possible, the speed governor 6 is associated with the bobbin in a stationary manner at each spinning station. Alternatively, the speed governor may, as described, be disposed on the maintenance device 2 and be advanced up to the bobbin for effecting the bobbin change and/or piecing process, for example, in the form of the drive roller 20 and its drive 200.

The outlined method and the described apparatus may, therefore, be modified in many ways, for example, by replacing individual features with equivalent features or using individual features in different combinations. Thus, for example, it is of secondary importance whether the drive roller 20 is placed onto the bobbin before the bobbin has been lifted from the winding cylinder 40, or whether this application of the drive roller 20 is effected at the moment when the bobbin lifts or, as described above, not until after the bobbin has lifted. The sequence may be freely selected. It is only necessary to ensure that the braking action does not set in until after the full bobbin has been lifted from the winding cylinder 40 to prevent the bobbin from being simultaneously exposed to the drive action of the winding cylinder 40 and the braking action of the drive roller 20.

The same purpose is also served by the described process of bringing the drive roller 20, prior to its application onto the full bobbin, to the peripheral speed of the bobbin so that the drive roller 20, prior to setting in of the braking action, does not first have to be accelerated by the bobbin.

In the illustrated embodiment, braking of the bobbin is effected electrically by means of a reversible d.c. motor (drive 200) but it is also conceivable to us an eddy-current brake or the like or even a mechanical brake as the braking device 26 for the drive roller 20 or its drive 200.

In the above description of the drive of the empty tube 45, a cylindrical empty tube 45 was presupposed, whose peripheral speed during formation of the reserve winding 32 has to be lower than that of the pair of take-off rollers 11 on account of the absence of cross-winding of the thread. If, however, a conical bobbin is being formed, the reserve winding 32 is usually formed at the end of the empty tube 45 having the greater diameter. Here, in order to maintain the desired thread wind-on tension, the peripheral speed of the conical empty tube 45 generally has to be lower than that of the pair of take-off rollers 11.

The correct winding speed and hence the correct peripheral speed of the drive roller 20 may be achieved in a simple manner by measuring the tension of the thread between the pair of take-off rollers 11 and the winding device 4. The peripheral speed of the drive roller 20 is then selected in dependence upon this measured (normally preadjustable) winding tension, so that the preselected winding tension is substantially maintained irrespective of whether a cylindrical or conical bobbin is to be formed. The thread tension measuring instrument (not shown) required for this purpose should be disposed between the pair of take-off rollers 11 and the winding device 4.

In principle, the drive roller 20 may be disposed in a stationary manner at each spinning station. However, in modern machines which generally have a plurality of identical work or spinning stations adjacent to one another in one or two rows and which are serviced by at least one maintenance device 2 displaceable along the row(s), the possibility presents itself of disposing the drive roller 20, as well as other units which are needed, not for the normal work process, but merely for maintenance (piecing, bobbin changing), on the maintenance device 2.

In the illustrated embodiment, the bobbin change is triggered on reaching a preset thread length (taking into account a fixed tolerance thread length). The thread length may, in principle, be fixed in advance or, as shown, be adjustable by means of at least one setting element 144.

Instead of a thread length, however, the bobbin diameter may be used to trigger the bobbin change, the bobbin diameter being detected by a, possibly adjustable, light barrier (not shown) which is associated with the bobbin and signals attainment of a preset diameter to the spinning station control device 13 and to the control device 21, which in turn supplies a signal to this effect to the control device 21 on the maintenance device 2.

We claim:

1. A method of forming a reserve of parallel windings of a thread, which is delivered at a constant rate of speed from a work station, on the longitudinal end region of a rotating empty tube which is driven by a drive cylinder at a constant peripheral speed during normal thread winding operations, comprising the following steps:

a) bringing a drive roller into contact with the peripheral surface of said tube, which is lifted off from said drive cylinder;
b) driving said drive roller at a peripheral speed adapted to the constant thread delivery speed of the thread from the work station;
c) winding a reserve of parallel windings of said thread on one end of said tube;
d) displacing said thread to the middle of said tube after said reserve is completed;
e) adapting the peripheral speed of said drive roller to drive said tube at a speed which is corrected for the effective diameter of said tube and to the shortening of the path of said thread occasioned by said displacement of said thread to maintain a constant winding tension on said thread;
f) lowering said tube onto the peripheral surface of said drive cylinder after said reserve is completed; and
g) passing said thread to a crosswinding device and lifting said drive roller from the surface of said tube.

2. A method of forming a reserve as set forth in claim 1, including the steps of monitoring the winding tension of said thread and controlling the peripheral speed of said drive roller to maintain a constant winding tension on said thread.

3. A method of forming a reserve as set forth in claim 1, including the step of moving said drive roller to said empty tube before the formation of said reserve and maintaining said drive roller in contact with said tube until said thread is passed to said crosswinding device.

4. A method of forming a reserve as set forth in claim 3, including the steps of removing a full bobbin from said drive cylinder, brining said full bobbin into contact with said drive roller, braking said drive roller and said full bobbin to a stop, lifting said drive roller from said full bobbin and replacing it with said empty tube before bringing said drive roller in contact with said empty tube for the formation of said reserve.

5. A method of forming a reserve as set forth in claim 4, including the steps of making a piecer after a standstill of said work station, temporarily driving said drive roller in the winding direction while it is in contact with said full bobbin to receive said piecer and in the unwinding direction when said piecer is backwound from said bobbin for being removed together with a thread being delivered from said work station.

6. A method of forming a reserve as set forth in claim 4, including the step of driving said empty tube with said drive roller until said tube is placed in contact with said winding cylinder.

7. A method of forming a reserve as set forth in claim 6, including the step of reducing the peripheral speed of said drive roller while said empty tube is being placed onto said winding cylinder.

8. A method of forming a reserve as set forth in claim 7, including the step of braking said drive roller to reduce its peripheral speed.

9. A method of forming a reserve as set forth in claim 8, including the step of electrically braking said drive roller.

10. A method of forming a reserve as set forth in claim 9, including the steps of generating an electric characteristic which is proportional to the peripheral speed said drive roller, monitoring said characteristic, and discontinuing said braking when a predetermined peripheral speed is attained.

11. A method of forming a reserve as set forth in claim 10, including the step of generating a voltage as the electric characteristic.

12. A method of forming a reserve of parallel windings of a thread, which is delivered at a constant rate of speed from a work station, on the longitudinal end region of a rotating empty tube which is driven by a drive cylinder at a constant peripheral speed during normal thread winding operations, comprising the following steps:
a) holding said empty tube from said drive cylinder;
b) bringing a drive roller into contact with the peripheral surface of said tube while it is held from said drive cylinder;
c) driving said drive roller at a peripheral speed adapted to the constant thread delivery speed of the thread from the work station;
d) winding a reserve of parallel windings of said thread on one end of said tube;
e) displacing said thread to the middle of said tube after said reserve is completed;
f) adapting the peripheral speed of said drive roller to drive said tube at a speed which is corrected for the effective diameter of said tube and to the shortening of the path of said thread occasioned by said displacement of said thread to maintain a constant winding tension on said thread;
g) lowering said tube onto the peripheral surface of said drive cylinder after said reserve is completed; and
h) passing said thread to a crosswinding device and lifting said drive roller from the surface of said tube.

13. An apparatus for forming a reserve thread winding on a rotating empty tube, comprising:
a) a winding cylinder for driving a tube for winding thread thereon at a constant peripheral speed;
b) drive means for driving said winding cylinder at a constant peripheral speed;
c) lifting means for lifting a full bobbin from said winding cylinder and for receiving and holding an empty tube, when said full bobbin is removed from said lifting means, at a predetermined distance from said winding cylinder;
d) a bobbin changing device for removing said full bobbin and replacing it with an empty bobbin;
e) thread guide means associated with said lifting means for guiding said thread onto a longitudinal end region of said tube for forming a reserve of said thread on said tube;
f) a pair of takeoff rollers for said thread, driven at a constant peripheral speed;
g) a drive roller disposed adjacent to said bobbin but spaced therefrom for driving contact with said bobbin or said tube when it is held by said lifting means;
h) means to bring said drive roller into contact with said bobbin or said tube held by said lifting means;
i) drive means for driving said drive roller at a peripheral speed which is adapted to the peripheral speed of said takeoff rollers; and
j) control means connected to said drive roller drive means and to said pair of takeoff rollers to drive said empty tube with a peripheral speed to maintain a constant winding tension on said thread while said reserve is being wound.

14. An apparatus for forming a reserve on a tube as set forth in claim 13, wherein said drive roller and said lifting means are connected to a common control device.

15. An apparatus for forming a reserve on a tube as set forth in claim 13, wherein said drive roller has a braking device associated with it.

16. An apparatus for forming a reserve on a tube as set forth in claim 15, wherein said braking device is operated electrically.

17. An apparatus for forming a reserve on a tube as set forth in claim 16, wherein said braking device comprises a d.c. electric motor.

18. An apparatus for forming a reserve on a tube as set forth in claim 15, wherein a timing device is connected to said braking device.

19. An apparatus for forming a reserve on a tube as set forth in claim 15, further comprising a speed governor which is connected to said braking device for control purposes.

20. An apparatus for forming a reserve on a tube as set forth in claim 19, wherein said speed governor is disposed on a maintenance device which is movable alongside a plurality of work stations, each of which has a tube which is driven by a winding cylinder.

21. An apparatus for forming a reserve on a tube as set forth in claim 19, said speed governor comprises a measuring instrument for measuring an electric characteristic generated by a d.c. motor.

22. An apparatus for forming a reserve on a tube as set forth in claim 21, wherein said measuring instrument measures electric voltage.

23. An apparatus for forming a reserve on a tube as set forth in claim 15, wherein said braking device has a fault signal transmitter.

24. An apparatus for forming a reserve on a tube as set forth in claim 13, wherein said drive roller is disposed on a maintenance drive which is movable alongside a plurality of work stations, each of which has a tube which is driven by a winding cylinder.

25. An apparatus for forming a reserve on a tube as set forth in claim 13, wherein said drive roller is connected to a piecing device for control purposes.

26. An apparatus for forming a reserve on a tube as set forth in claim 13, wherein said drive roller is connected to a bobbin changing device for control purposes.

27. An apparatus for forming a reserve on a tube as set forth in claim 13, wherein said drive roller is a part of a bobbin changing device, a piecing device, and a braking device.

* * * * *